United States Patent [19]

Ohno

[11] 4,361,989

[45] Dec. 7, 1982

[54] POLISHING APPARATUS

[76] Inventor: Tetatsu Ohno, 1-2, 1-chome, Kasuya, Setagaya-ku Tokyo, Japan

[21] Appl. No.: 184,214

[22] Filed: Sep. 5, 1980

[30] Foreign Application Priority Data

Sep. 13, 1979 [JP] Japan ..... 54-117650

[51] Int. Cl.[3] ..... B24B 31/04

[52] U.S. Cl. ..... 51/164.1

[58] Field of Search ..... 51/163.1, 164.1, 164.2, 51/7

[56] References Cited

U.S. PATENT DOCUMENTS

| | | | |
|---|---|---|---|
| 1,482,923 | 2/1924 | Goke | 51/164.1 |
| 1,491,601 | 4/1924 | Fuller | 51/164.2 |
| 1,537,520 | 5/1925 | Abbott | 51/164.1 |
| 1,538,231 | 5/1925 | Abbott | 51/164.2 |
| 1,602,660 | 10/1926 | Groeniger | 51/164.1 |
| 3,464,163 | 9/1969 | Ferrara | 51/163.1 |
| 3,611,638 | 10/1971 | Deede | 51/163.1 |
| 4,173,851 | 11/1979 | Higashi | 51/7 |

FOREIGN PATENT DOCUMENTS

| | | | |
|---|---|---|---|
| 972709 | 9/1959 | Fed. Rep. of Germany | 51/164 |

*Primary Examiner*—Harold D. Whitehead

*Attorney, Agent, or Firm*—Laurence R. Brown

[57] ABSTRACT

A polishing bath is charged with polishing materials so that workpieces may be barrel-polished. Supporting members for holding the workpieces in the polishing bath are provided and are set under their free or rotatable condition. According to this barrel polishing operation, the workpieces are prevented from colliding against one another during the polishing operation, thus raising no fear of forming the products with scars and dents.

1 Claim, 4 Drawing Figures

POLISHING APPARATUS

BACKGROUND OF THE INVENTION

1. Field of the Invention

The present invention relates to such improvements in a polishing method and an apparatus therefor as can prevent workpieces from rubbing and colliding against one another and from being formed with scars or dents when the barrel polishing bath of a centrifugal barrel polishing machine, a rotary barrel polishing machine, a vibration barrel polishing machine or the like is loaded with the workpieces so that they may be polished.

2. Description of the Prior Art

The centrifugal barrel polishing machine, the rotary barrel polishing machine, a vibration barrel polishing machine or the like according to the prior art has a drawback that workpieces rub and collide so they are scarred and dented if they are poured merely at random into the polishing bath of any of those polishing machines so that they may be polished in case the polishing bath is charged with the polishing materials.

SUMMARY OF THE INVENTION

According to the present invention, workpieces are mounted in a jig, whereas this jig itself is held under a free condition or under a quasi-free or rotatable condition within a polishing bath, and this bath is turned at a suitable speed from low to high speeds in accordance with the purpose so that the polishing materials in the polishing bath may accomplish their polishing operations with a wide range of fluidity.

It is, therefore, an object of the present invention to provide a polishing apparatus which is free from the aforementioned drawbacks concomitant with the prior art.

Further objects, advantages and features of the present invention will become more fully apparent from a detailed consideration of the arrangement and construction of the consituent parts as set forth in the following specification taken together with the accompanying drawings.

DESCRIPTION OF THE PREFERRED EMBODIMENTS

Figure 1:
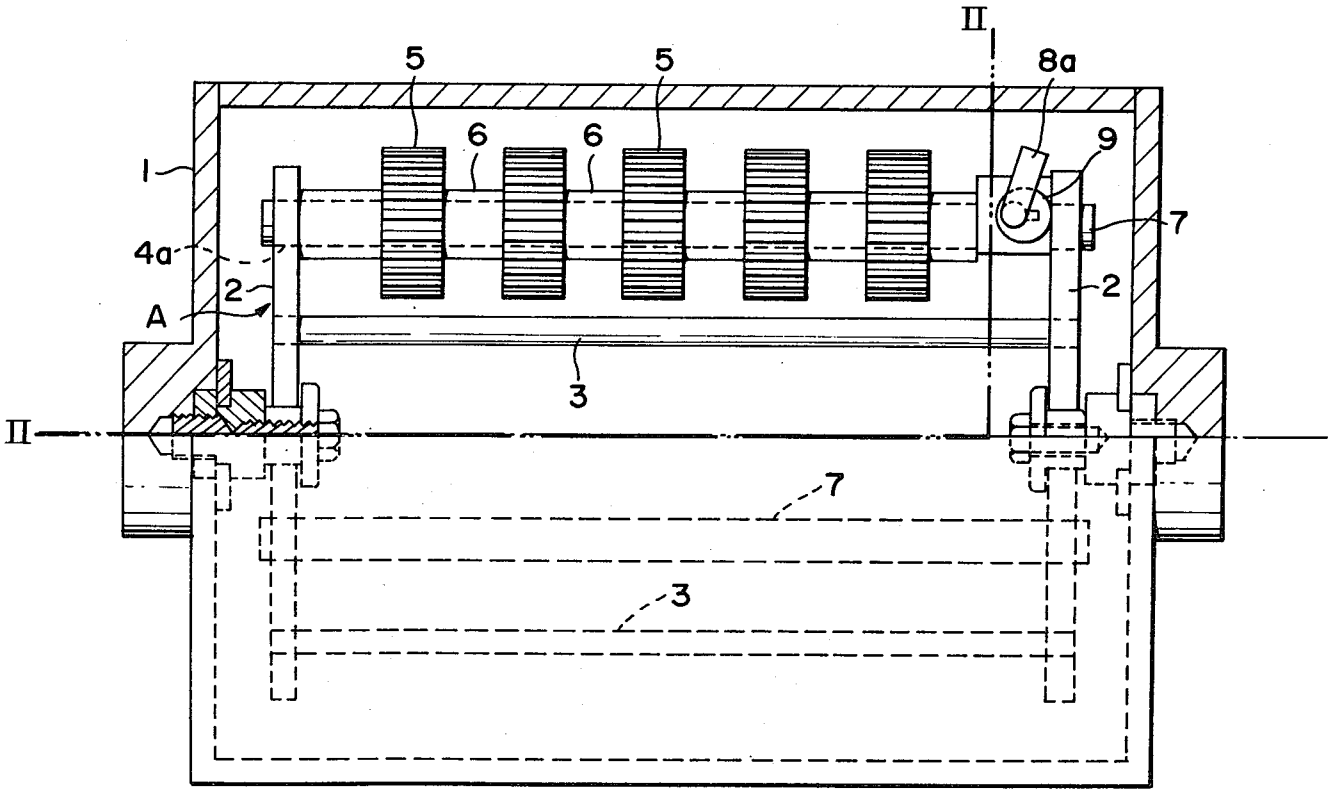
FIG. 1 is a partially cut-away front elevation showing one embodiment of an apparatus according to the present invention.
Figure 4:
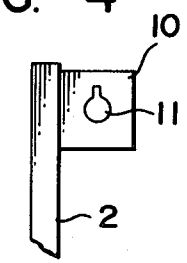
FIG. 4 is a side elevation showing a supporting plate.
Figure 3:
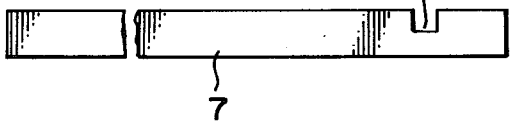
FIG. 3 is a front elevation showing a rod-shaped support.
Figure 2:
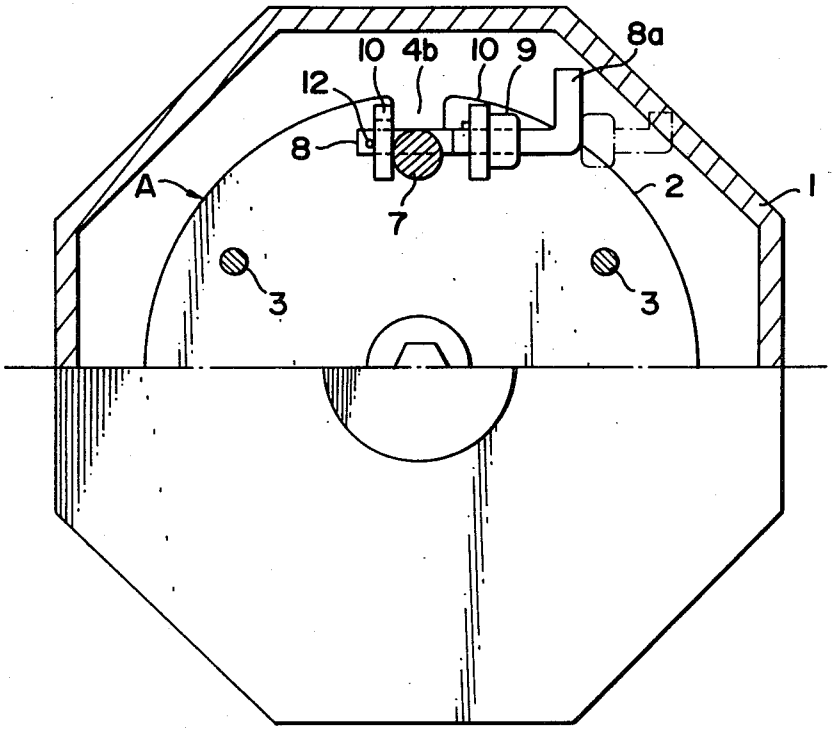
FIG. 2 is a lefthand side elevation taken along line II—II of FIG. 1.

FIG. 1 is a partially cut-away front elevation showing one embodiment of an apparatus according to the present invention, and FIG. 2 is a lefthand side elevation taken along line II—II of FIG. 1. In these Figures, reference numeral 1 indicates a barrel polishing bath of any shape such as a circular or polygonal shape, which is so rotatably mounted that it is turned by a (not-shown) motor. Needless to say, the polishing barrel 1 is turned at a suitable speed from low to high speeds in accordance with the purpose so that the polishing or grinding materials in the bath 1 may accomplish widely fluidic and frictional motions from low speed rotational motions to high speed centrifugal motions. On the other hand, it is quite natural that the polishing or grinding materials can be replaced by others in accordance with their uses. Now, reference letter A indicates a jig, on which the workpieces are mounted and which circular or polygonal side plates 2 and 2 having a more or less smaller diameter than the inside diameter of the aforementioned polishing bath 1 are retained at the both ends thereof by means of retaining rods 3 (which are three in number in the Figures). The side plates 2 and 2 are formed in their circumferences with plural pairs (which are three in number in the Figures) of through holes **4*a* at one side and notches 4*b* (Reference should be made to FIG. 2) at the other side. Rod-shaped supports 7, which are inserted into workpieces 5 such as gears through spacers 6, are inserted into the through holes 4*a* and the notches 4*b* until they are removably fixed thereto. Needless to say, the rod-shaped supports 7 may be fixed to the side plates 2 and 2 by means of screws. As shown in FIG. 3, however, according to an alternative, each of the rod-shaped supports 7 is formed with a groove 7*a*, whereas an eccentric ring 9 is mounted on an L-shaped shaft 8 having a handle 8*a*. This shaft 8 is inserted into the through holes 11 (Reference should be made to FIG. 4) of supporting plates 10 and 10, which are disposed at the both sides of the notch 4*b***. *Then, the handle* **8*a* is turned so that the eccentric ring 9 is forced to abut against the side plate 2 thereby to lock with the side plate 2. Needless to say, if it is intended to remove the rod-shaped supports 7 from the jig A, the handle 8*a* is turned in the opposite direction to loosen the forced contact between the eccentric shaft 9 and the side plate 2 so that the shaft 8 is extracted from the supporting plates 10 and 10 to release the engagement with the groove 7*a* of the support 7. Thus, this support 7 can be removed from the jig A without any difficulty. This method leads an advantage that the supports 7 can be removed from the jig A by the simple operations. Since, in this case, the shaft 8 is not fixed in its axial movement, a pin 12 is attached to one end portion of the shaft 8. This pin 12 is held in engagement with the supporting plate 10 during the fixation. Upon the removal, the supporting plate 10 is formed at its through hole 11 with a pin hole, as shown in FIG. 4, such that the shaft 8 can be extracted together with the pin 12 at a position where the handle 8*a*** is turned to loosen the forced contact, as shown in broken lines.

I claim:

1. An improvement in rotatable barrel polishing apparatus containing a polishing bath for circulating about workpieces to polish them as the barrel rotates about an axis, comprising in combination, workpiece support means disposed axially within the barrel holding separated side plates positioned at opposite ends of the barrel in the polishing bath to rotate inside the barrel in response to rotation of the barrel, fixtures in said side plates adapted to removably hold a plurality of longitudinally disposed workpiece retaining members in place between said side plates, rod shaped workpiece retaining members supporting workpieces thereon held in place in said fixtures for rotation within said barrel with said workpiece support means wherein said side plates include notches formed therein for receiving said rod shaped members, and the fixtures comprise an L-shaped shaft equipped with an eccentric ring, a groove in said rod like members near one end, supporting plates formed with through holes at the both sides of one of the notches mounted on at least one side plate for disposing the L-shaped shaft perpendicular to the axis, wherein the L-shaped shaft is inserted into said through holes and engages said groove to retain the shaft in one of said notches with the eccentric ring disposed for forced contact with the side plate thereby to removably retain the rod shaped member for removal by rotation of the eccentric ring by means of the L-shaped shaft.

* * * * *